US005915596A

United States Patent [19]

Credle, Jr.

[11] Patent Number: 5,915,596

[45] Date of Patent: Jun. 29, 1999

[54] DISPOSABLE LIQUID CONTAINING AND DISPENSING PACKAGE AND METHOD FOR ITS MANUFACTURE

[75] Inventor: William S. Credle, Jr., Stone Mountain, Ga.

[73] Assignee: The Coca-Cola Company, Atlanta, Ga.

[21] Appl. No.: 08/926,116

[22] Filed: Sep. 9, 1997

[51] Int. Cl.[6] ..... B65D 35/56

[52] U.S. Cl. ..... 222/105; 222/464.1

[58] Field of Search ..... 222/92, 95, 105, 222/183, 464.1, 107

[56] References Cited

U.S. PATENT DOCUMENTS

| | | | |
|---|---|---|---|
| 2,804,257 | 8/1957 | Hasler et al. . | |
| 2,891,700 | 6/1959 | Maynard . | |
| 3,090,526 | 5/1963 | Hamilton et al. . | |
| 3,197,073 | 7/1965 | Gondra et al. . | |
| 3,260,412 | 7/1966 | Larkin . | |
| 4,062,475 | 12/1977 | Harris et al. . | |
| 4,087,026 | 5/1978 | Peterson . | |
| 4,138,036 | 2/1979 | Bond . | |
| 4,257,535 | 3/1981 | Mellett . | |
| 4,266,692 | 5/1981 | Clark . | |
| 4,286,636 | 9/1981 | Credle . | |
| 4,381,846 | 5/1983 | Heck . | |
| 4,524,458 | 6/1985 | Pongrass et al. . | |
| 4,601,410 | 7/1986 | Bond . | |
| 4,893,731 | 1/1990 | Richter | 222/92 |
| 4,998,990 | 3/1991 | Richter et al. | 222/92 |
| 5,647,511 | 7/1997 | Bond . | |
| 5,749,493 | 5/1998 | Boone et al. | 222/105 |

FOREIGN PATENT DOCUMENTS

| | | | |
|---|---|---|---|
| WO 86/00868 | 1/1986 | WIPO | 222/105 |

*Primary Examiner*—Philippe Derakshani
*Attorney, Agent, or Firm*—Dennis W. Braswell

[57] ABSTRACT

A flexible bag for liquid including a spout and an elongated dip strip inside the bag and underlying the spout. The ends of the strip are heat sealed between opposing bag walls in opposing peripheral edges of the bag. The strip includes a liquid passage except at the flat ends thereof and is located directly below the spout opening. The liquid passages provide liquid communication for the liquid from the far reaches of the bag interior to the spout as the bag collapses during evacuation.

7 Claims, 2 Drawing Sheets

DISPOSABLE LIQUID CONTAINING AND DISPENSING PACKAGE AND METHOD FOR ITS MANUFACTURE

BACKGROUND

1. Field of the Invention

This invention relates to a disposable package for containing a liquid to be dispensed therefrom, and more particularly to such a package, and a method for its manufacture, wherein the package includes a flexible bag, a spout and a flat dip strip therein for providing a liquid passage out of the bag as the bag progressively collapses during evacuation.

2. Description of the Prior Art

Bag-in-box systems are well-known in the art for containing and dispensing liquids, such as syrup for soft drinks, milk and water. Such known systems include an outer protective and supporting shell of cardboard, and an inner, flexible, collapsible plastic bag. The flexible bag has a spout to which is connected a bag valve coupling, to which, in turn is connected a hose connector of a hose for dispensing the liquid from the bag.

The bag can be oriented with the spout at the lowermost portion of the bag to attempt to dispense most of the liquid therefrom, or alternatively the bag can be provided with a dip tube or a dip strip and the bag can then be oriented with the spout at the top, or at any other location, because the dip strip will aid in withdrawing all of the liquid from the bag. The following U.S. Patents show such known bags: U.S. Pat. No. 4,286,899, U.S. Pat. No. 5,647,511 and U.S. Pat. No. 4,524,458.

SUMMARY OF THE INVENTION

A disposable liquid containing and dispensing package including a flexible bag, a spout in the bag having an opening through which the bag can be filled and emptied, and an elongated strip located inside the bag and located to provide liquid communication with the opening in the spout as the bag collapses during evacuation for aiding in the withdrawal of liquid from the bag. The dip strip is located inside of the bag when the bag is made and is secured in the desired location by having its two ends being heat sealed between the bag walls in opposed peripheral edges of the bag.

It is an object of the present invention to provide a liquid package including a flexible bag, a spout and a flat dip strip, and a method for its manufacture.

It is another object of this invention to provide such a package wherein the flat dip strip is located inside the bag when the bag is made and is not connected to the spout.

BRIEF DESCRIPTION OF THE DRAWINGS

The present invention will be more fully understood from the following detailed description when read in connection with the accompanying drawings wherein like reference numerals refer to like elements and wherein.

DETAILED DESCRIPTION OF THE PREFERRED EMBODIMENT

Figure 1:
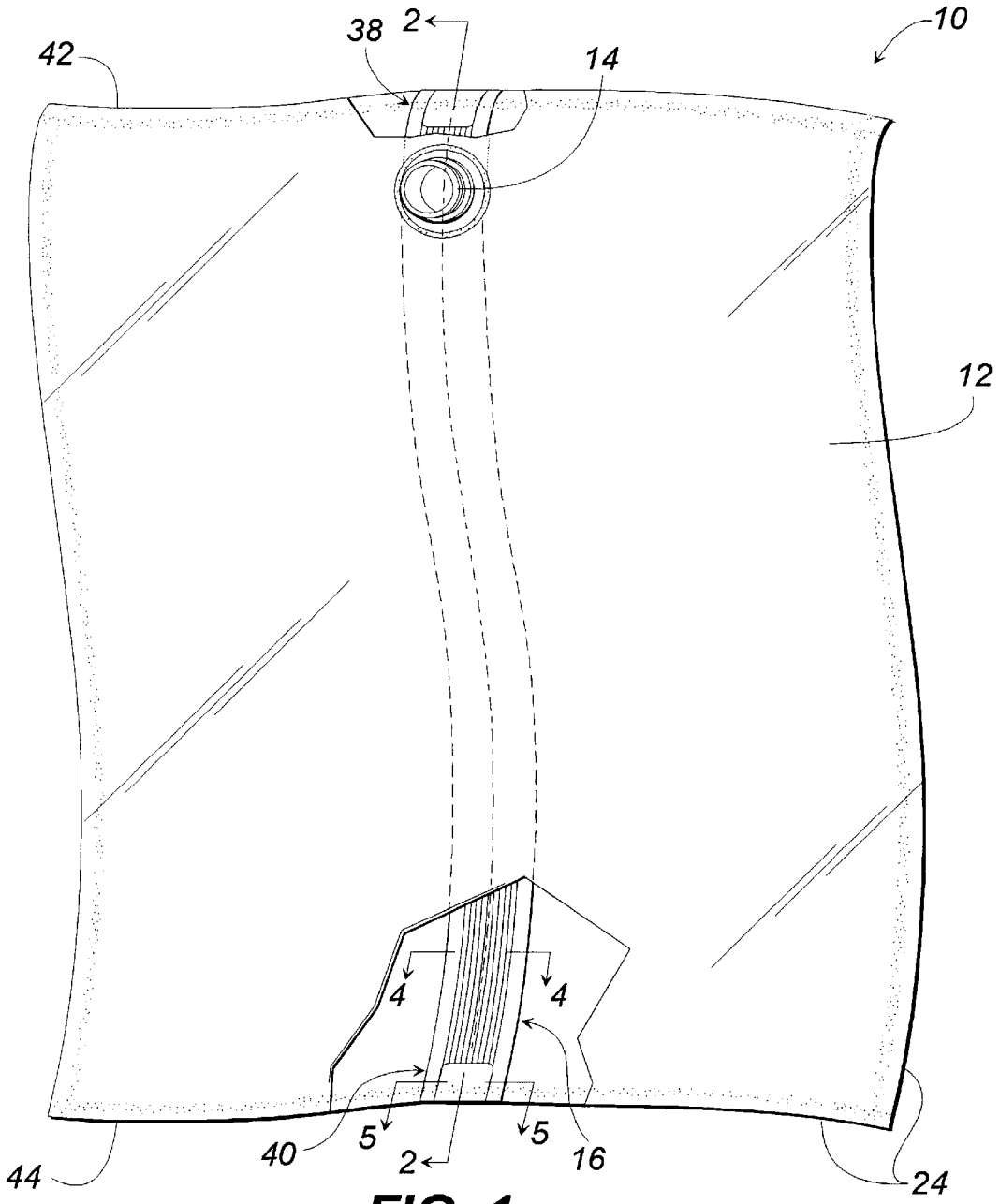
FIG. 1 is a partly cut-away perspective view of the package of the present invention.
Figure 2:
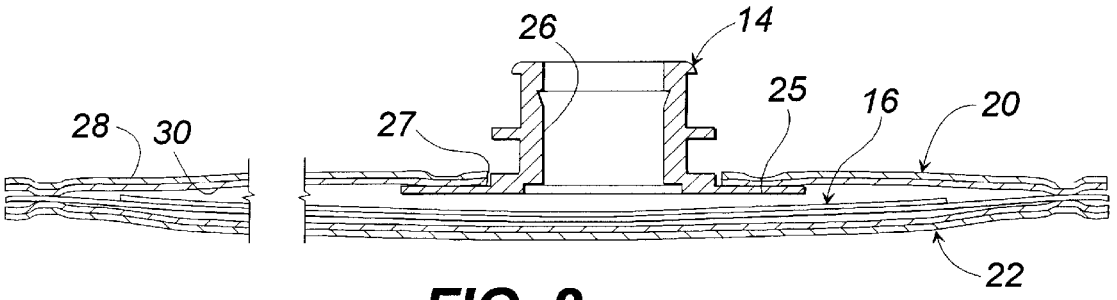
FIG. 2 is a cross-sectional view taken along line 2—2 of FIG. 1.
Figure 3:
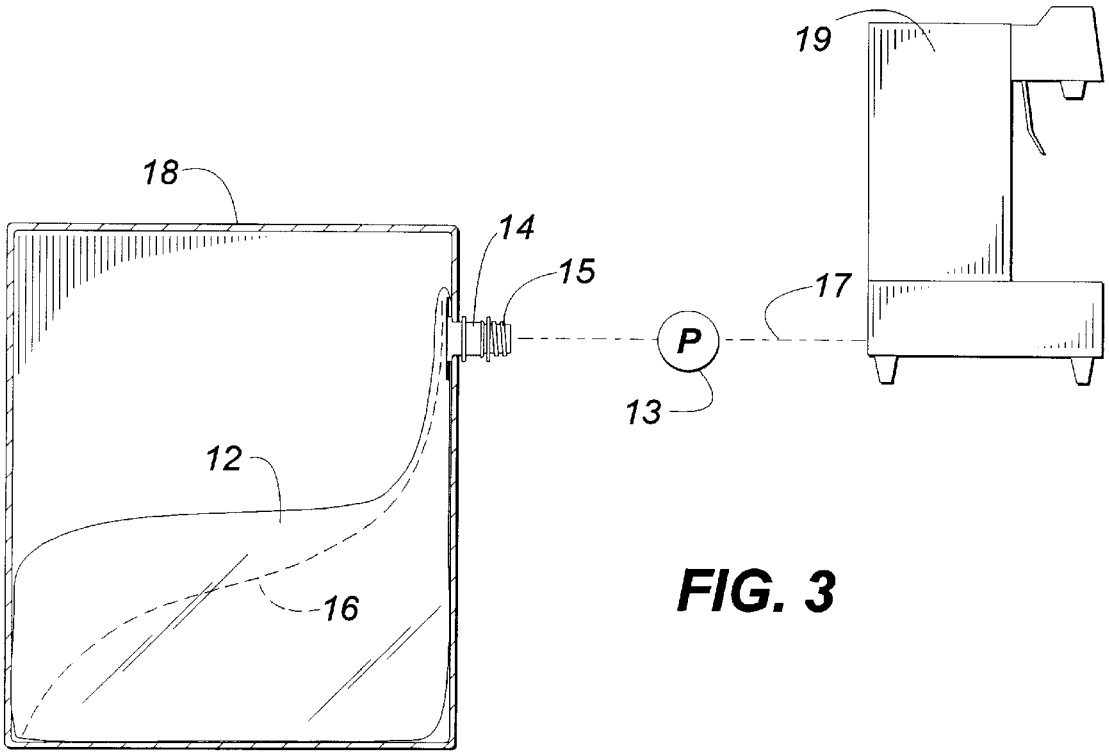
FIG. 3 is a diagrammatic view of a half-full bag of this invention in a box and connected to a postmix dispenser through a hose having a pump therein.
Figure 4:
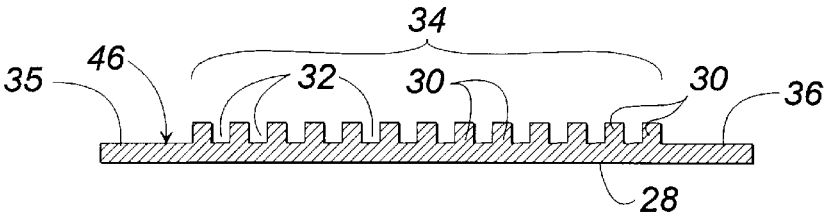
FIG. 4 is a cross-sectional end view through the dip strip taken along line 4—4 of FIG. 1.
Figure 5:
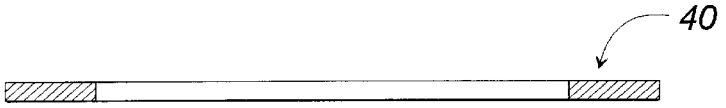
FIG. 5 is a cross-sectional end view through a flat end of the dip strip taken along line 5—5 of FIG. 1.

With reference now to the drawings, FIGS. 1–5 show a package 10 according to the present invention including flexible bag 12, a spout 14 and a flat dip strip 16 inside the bag 12.

A preferred use for the package 10 (see FIG. 3) is in a bag-in-box post-mix beverage system for supplying syrup to a post-mix soft drink dispenser. In such use, it is known to place the package 10, with a bag valve 15 connected to the spout 14, in a cardboard box 18, and to connect a syrup hose 17, having a pump 13 therein, to the package by connecting a hose coupling to the bag valve 15. The hose 17 supplies syrup to a postmix dispenser 19.

Although any suitable flexible bag can be used, a preferred bag 12 comprises a pair of walls 20 and 22 connected together at their peripheries 24 by heat sealing. The flexible walls 20 and 22 preferably each comprise two plys 28 and 30. The inside ply 30 is a web of 2 mil LLDPE. The outside ply 28 comprises a 4 mil coextrusion layer of LLDPE/nylon/LLDPE, with tie layers on each side of the nylon. The two LLDPE layers are preferably about 1.4 mil, the nylon about 1.0 mil, and the tie layers about 0.1 mil.

The spout 14 has a flange 25 that is heat sealed to the upper bag wall 20. The spout 14 has an opening 26 that mates with an opening 27 in the upper bag wall. The bag is filled and emptied through the spout. An opening is cut through both plys of the upper bag wall in the desired location, and then the spout is inserted through such opening 27 with the flange 25 on the inside of the bag and the flange is then heat sealed to the inner ply which is, in turn and at the same time, heat sealed to the outer ply.

The flat dip strip 16 has an upper surface 46 facing the spout 14 and upper wall 20. The strip includes a flat base 28 and a plurality of ribs 30 to provide a plurality of liquid passages 32 providing liquid communication along substantially the entire length of the dip strip, except for the ends 38 and 40. The passages 32 are preferably parallel to each other and extend parallel to the longitudinal direction of the dip strip 16.

The flat dip strip 16 is preferably extruded which provides the advantage that it can be made inexpensively. The flat dip strip is preferably secured inside the bag as follows. The two ends 38 and 40 of the dip strip 16 are flat, preferably by having the central section 34 thereof that contains the ribs, cut out, leaving only the two flat side sections 35 and 36 in the ends 38 and 40. These two ends are placed between the two walls 20 and 22 at opposite peripheral edges 42 and 44 of the bag and heat sealed in place when the peripheral edges of the walls are heat sealed to form the bag. This procedure locates the strip in the bag when the bag is made and also locates the strip relative to the spout, that is, directly below the spout opening 26, so that the strip will always be positioned to provide liquid communication to the spout from the far reaches of the bag, through the passages 32, as the bag collapses on the strip during evacuation.

It will be apparent that various alterations, modifications, and changes can be made in the preferred embodiment described herein without departing from the spirit and scope of the present invention as defined in the appended claims. For example, other dip strips can be used in place of the preferred one described above. Other numbers and shapes of passages can be used if desired.

I claim:

1. A disposable liquid containing and dispensing package comprising:

(a) a flexible bag including a pair of bag walls, an upper and a lower bag wall, sealed at their peripheral edges and adapted to be filled with a liquid to be dispensed therefrom;

(b) said bag including an opening through said upper wall and including a spout having a spout opening mating with said bag opening, through which spout opening said bag can be filled and emptied; and (c) an elongated dip strip located inside of said bag and having a pair of flat ends that are sealed between said bag walls at opposed peripheral edges thereof and being located directly below said spout opening with an upper surface facing toward said spout, said strip including at least one elongated liquid passage on said upper surface extending between said flat ends for providing a liquid passage from the interior of said bag to said spout as said bag progressively collapses.

2. The package as recited in claim 1 wherein said spout is located adjacent one peripheral edge of said bag.

3. The package as recited in claim 2 wherein said dip strip is extruded and said flat ends are heat sealed between said bag walls when said bag is made.

4. The package as recited in claim 1 wherein said dip strip is flat and has an upper surface facing said upper wall and includes a solid imperforate base and a plurality of elongated ribs on said upper surface located in-line and side by side, and providing said liquid passages.

5. The package as recited claim 1 wherein said strip is extruded and includes a central section with said at least one liquid passage and a pair of flat side sections, and wherein said central section is cut out at said ends to provide said flat ends.

6. A method for providing a disposable liquid containing and dispensing package including a flexible bag including a pair of bag walls sealed at their peripheral edges and adapted to be filled with a liquid to be dispensed therefrom, said bag including an opening through one wall and including a spout having a spout opening mating with said bag opening, through which said bag can be filled and emptied, and an elongated dip strip located inside of said bag and having a pair of flat ends that are sealed between said bag walls at opposed peripheral edges thereof and being located directly below said spout opening with an upper surface facing toward said spout, said strip including at least one elongated liquid passage on said upper surface extending between said flat ends for providing a liquid passage from the interior of said bag to said spout as said bag progressively collapses, comprising the steps of:

(a) heat sealing said bag walls together at their peripheries to form said bag, with said dip strip being inside of said bag; and (b) heat sealing said flat ends of said strip between said bag walls at opposed peripheral edges thereof with said strip and said passage being located directly below said spout opening and providing liquid communication between the interior of said bag and said spout opening as said bag collapses during evacuation.

7. The method as recited in claim 6 wherein said strip is extruded and includes a central section with said at least one liquid passage and a pair of flat side sections, and including the step of cutting out said central section adjacent each end of said strip to provide said flat ends.

* * * * *